US005333364A

United States Patent [19]

Enfield et al.

[11] Patent Number: 5,333,364

[45] Date of Patent: Aug. 2, 1994

[54] METHOD FOR PRODUCING RANDOM YARN DENIER VARIATIONS ON DRAW WARPING MACHINES

[75] Inventors: Jeffrey J. Enfield; William S. Harmon, both of Greensboro; McDaniel L. Beard, Burlington, all of N.C.

[73] Assignee: Guilford Mills, Inc., Greensboro, N.C.

[21] Appl. No.: 803,324

[22] Filed: Dec. 4, 1991

[51] Int. Cl.[5] ..... D02J 1/06

[52] U.S. Cl. ..... 28/172.2; 28/243

[58] Field of Search ..... 28/243, 252, 253, 172.1, 28/172.2, 194, 258; 57/287, 288

[56] References Cited

U.S. PATENT DOCUMENTS

| | | | |
|---|---|---|---|
| 3,561,045 | 2/1971 | Heffernan | 28/243 |
| 3,611,521 | 10/1971 | Corbiere | 28/243 |
| 3,662,055 | 5/1972 | Bates | 264/167 |
| 4,044,089 | 8/1977 | Cochran et al. | 28/243 |
| 4,059,950 | 11/1977 | Negishi et al. | 57/288 |
| 4,147,749 | 4/1979 | Lipscomb et al. | 264/167 |
| 4,152,886 | 5/1979 | Nelson | 28/252 |
| 4,242,862 | 1/1981 | Negishi et al. | 28/243 |
| 4,389,364 | 6/1983 | Endo | 28/243 |
| 4,669,159 | 6/1987 | Bogucki-Land | 28/185 |
| 4,715,097 | 12/1987 | Bogucki-Land | 28/172 |
| 4,852,225 | 8/1989 | Hagewood et al. | 28/172 |
| 5,066,447 | 11/1991 | Knox et al. | 28/172.2 |

OTHER PUBLICATIONS

"Contempory Textile Engineering" F. Happey, Academic Press, 1982 pp. 20–23.

"The Karl Mayer Draw-Beam System," Fiber World, pp. 67–68.

"Mayer Warp Drawing Machine Developed Further," *Man-Made Year Book* (CTI), pp. 104–105.

Dipl.-Ing. G. Becker, Dipl.'Ing. W. Wiesel; "Effect of Machine Downtimes in Draw-Warping on Yarn Properties," Manmade Fiber Year Book (CTI).

*Primary Examiner*—Clifford D. Crowder
*Assistant Examiner*—Larry D. Worrell, Jr.
*Attorney, Agent, or Firm*—Shefte, Pinckney & Sawyer

[57] ABSTRACT

The present invention discloses a method of draw warping a plurality of partially oriented synthetic continuous filaments traveling in parallel side by side relation to produce denier variations randomly along the length of each filament and randomly from filament to filament. This is accomplished by transporting the filaments collectively through a draw zone defined between first and second filament engaging members and by imposing a common lengthwise stretching force simultaneously to the filaments with the draw zone while heating the filaments and, finally, by causing the filaments to slip randomly and draw non-uniformly on at least one of the filament engaging members.

9 Claims, 1 Drawing Sheet

METHOD FOR PRODUCING RANDOM YARN DENIER VARIATIONS ON DRAW WARPING MACHINES

THE FIELD OF THE INVENTION

The present invention relates to the production of random denier variations in textile yarns, particularly synthetic continuous filament yarns.

BACKGROUND OF THE INVENTION

Methods for making random yarn denier variations are known in the art. Variable denier yarns of synthetic polymers are useful in providing the means of producing variable texture and dying effects in the fabrics made therefrom. Thus, mottled or other novelty effects can be produced when the fabric is dyed with a given dye stuff owing to the varying rates and extents to which the dye stuff is taken up by the portions of different deniers.

Drawing is a process typically used on synthetic yarns. Virtually all synthetic filament yarns are drawn to provide for molecule orientation within the yarn. There are three conventional or draw twisting types of drawing. In the first method, known as spin drawing, each individual synthetic filament is drawn during the spinning process. The second method is termed draw warping and is used in weaving or warp knitting. Here, multiple filaments are drawn collectively in parallel side-by-side relation in the form of a sheet of filaments. In the third, each individual synthetic filament is drawn individually in a process separate and apart from the spinning process.

Previous methods have shown that irregularity or unevenness in the fiber thickness of individual filaments can be formed in synthetic filaments during spin drawing by changing the extrusion amount, the take-up speed, the spun length or the spinning atmosphere in the spinning step, or by changing the spin draw ratio, the spin drawing zone length or the spin drawing atmosphere in the drawing step. U.S. Pat. No. 4,147,749 to Lipscomb et al discloses a method for producing fibers during spin drawing from synthetic polymeric materials having randomly produced sections of high and low orientation and varying cross section areas. The varied orientation and cross section areas are produced by quickly cooling the fiber and drawing the fiber below its natural draw ratio.

The known methods of draw-induced denier variations are performed only during spin drawing, not draw warping. Inducement of denier variation on the draw warping process has not been tried or accomplished because it is important that the denier randomness vary not only along the length of each filament but also laterally across the length of the warp sheet from one filament to the next. Thus, since the draw warping process treats the same lengthwise point of each filament at the same time, it would be expected that draw-induced denier variations performed during draw warping would not accomplish the goal of random variations from filament to filament but, instead, produce variations at the same lengthwise points in each filament. Thus, no method for producing random yarn denier variations in draw warping machines has been developed.

SUMMARY OF THE INVENTION

It is therefore an object of the present invention to provide for a method of producing random yarn denier variations randomly both along the length of each filament and from filament to filament on a draw warping machine.

These and other objects of the present invention are provided through a method of draw warping a plurality of partially oriented synthetic continuous filaments traveling in parallel side by side relation to produce denier variations randomly along the length of each filament and randomly from filament to filament. This is accomplished by transporting the filaments collectively through a draw zone defined between first and second filament engaging members and by imposing a common lengthwise stretching force simultaneously to the filaments with the draw zone while heating the filaments preferably below their glass transition temperature and, finally, by causing the filaments to slip randomly on at least one of the filament engaging members. In this method, the slipping may be caused by imposing a draw ratio on the filaments which is less than a normal range of draw ratios utilized when draw warping the filaments to a uniform denier. It is also preferable to apply an amount of heat to the filaments which is less than a normal heating range utilized when draw warping the filaments to a uniform denier. To aid in this purpose, the filaments may be transported through the draw warping unit at a traveling speed which is greater than a normal range of traveling speeds utilized when draw warping the filaments to a uniform denier.

More specifically, the method of draw warping a plurality of yarns to produce random yarn denier variations along the length of each yarn and from yarn to yarn comprises the steps of providing a draw unit having devices for lengthwise stretching of plural yarns in the form of a warp sheet in a draw zone defined between first and second yarn engaging members and a device for heating the yarns above their glass transition temperature to facilitate drawing. The unit is normally operable when draw warping the yarns to a uniform denier to impose a predetermined ratio of drawing on the yarns within a normal range of draw ratios and to apply a predetermined amount of heat to the yarns within a normal heating range. However, in the instant invention, the yarns are drawn at a sufficiently lower draw ratio than the normal draw ratio range to cause the yarns to slip irregularly. The denier variations thusly produced may also be promoted by applying a lesser amount of heat to the yarns than is applied in a normal heating range of draw warping.

The yarn engaging members typically are spaced differentially driven drive rollers. A pin may also be employed to engage the filaments at a location between the drive rollers. The pin is normally non-rotatable in draw warping units when draw warping the filaments to a uniform denier. However, for purposes of the instant invention, the pin may freely rotate under the traveling movement of the filaments. Draw warping units may also include heating devices for normally preheating the filaments in advance of the heating device which heats the filaments to their glass transition temperature. Such preheating devices may include means for heating the pin described above. However, the present method described above preferably contemplates deactivation of the preheating devices.

In the preferred embodiment, the method of draw warping a plurality of yarns to produce random yarn denier variations randomly along the length of each yarn and from yarn to yarn comprises the steps of driving the plurality of yarns through draw warping feed rollers which are heated to approximately 60 percent or less of the feed rollers' normal draw warping temperature. The warp threads are then guided over at least one deflecting device. The deflecting device may be the pin and which preferably provides essentially no heat to the warped threads and is mounted to rotate freely. Next, the warp threads are moved over a heating plate and the warp threads are then driven through draw warp takeoff rollers. These activities occur while operating the draw warping machine at a lower than normal draw ratio, thereby causing the yarns to slip irregularly.

The method of the present invention produces surprising results in that the denier variations are produced not only randomly along the length of each yarn but also from yarn to yarn. This occurs even though the sheet of yarns travels through the draw warping unit in a uniform fashion, and, therefore, each point in the length of each yarn undergoes treatment by the unit at the same place and the same time. Thus, one would be led to believe that the denier variations would not be random from yarn to yarn but only along the length of each yarn. However, surprisingly, the denier variations are random from yarn to yarn.

DESCRIPTION OF THE PREFERRED EMBODIMENT

Figure 1:
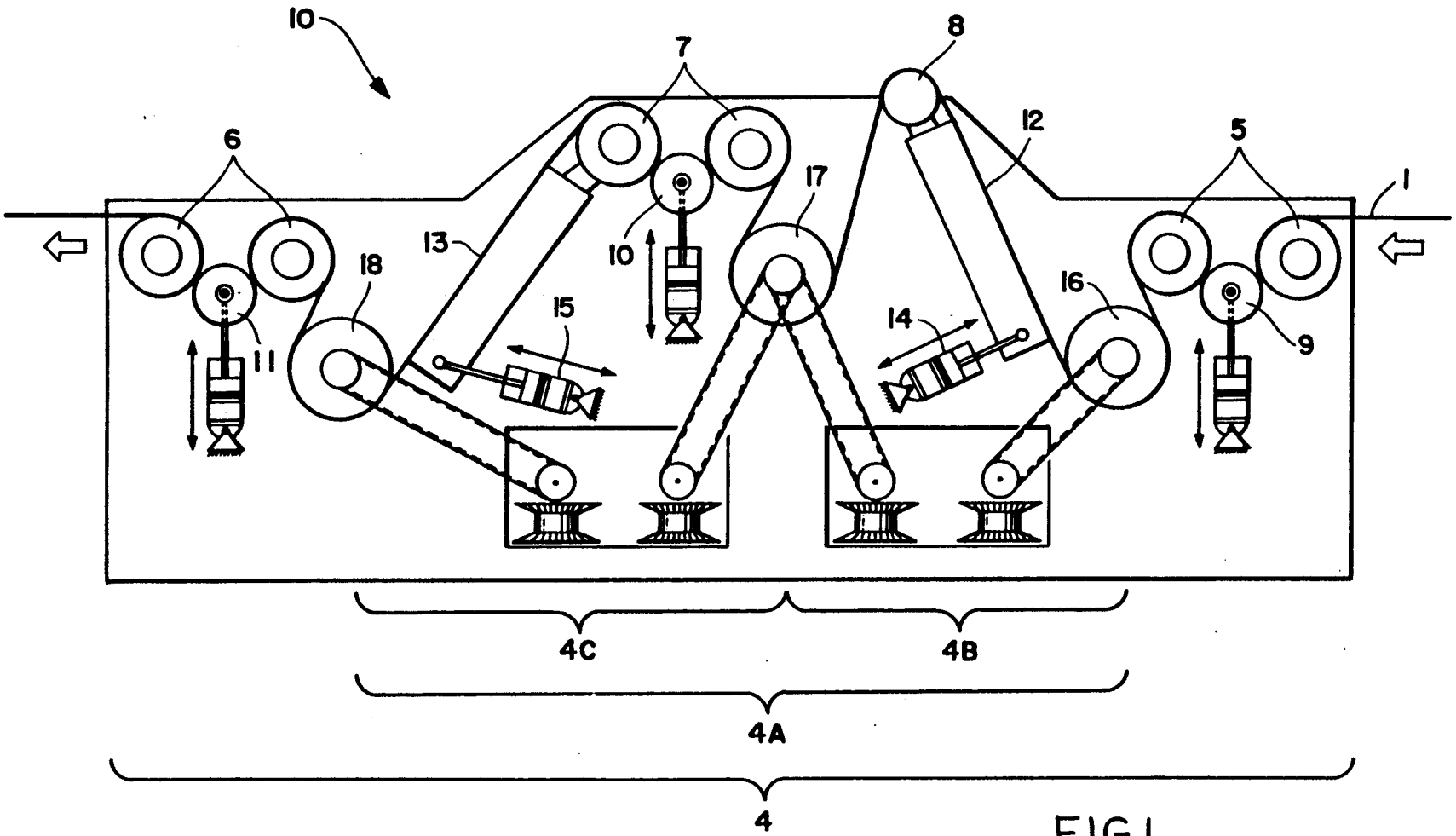
FIG. 1 illustrates a draw warping unit upon which the method of the present invention may be practiced.

Referring now to FIG. 1, a draw warping machine 10 is shown. The specific draw warping machine shown in FIG. 1 is known as a Karl Mayer Draw Warper Model DSST produced by Karl Mayer Textilmaschinenfabrik GmbH of Obertshausen, Germany, and is the preferred draw warping unit for use with the method of the present invention. However, those skilled in the art will understand that the method of the present invention may be performed on any draw warping unit and is not limited to the Karl Mayer draw warper shown in FIG. 1. A full description of a Karl Mayer draw warper can be found in U.S. Pat. No. 4,669,159 which was issued on Jun. 2, 1987, to Bogucki-Land and which is assigned to Karl Mayer Textilmaschinenfabrik GmbH, which is specifically incorporated herein by reference. Note that the DSST draw warper of FIG. 1 differs somewhat from the machine shown in the drawings of the '159 patent. The DSST model has an additional drive roller 17 to provide the machine with two draw zones, as described below more fully, and an additional set of rollers 7 known as draw or stretch rollers disposed within the second draw zone.

In a draw warping machine as shown in FIG. 1, prestressed partially oriented synthetic filaments 1 are pulled from creel-supported spools (not shown) from the right hand side of the drawing and brought together in side-by-side parallel relation as a collective thread sheet to move through the draw unit 4. The draw unit shown in FIG. 1 has an overall draw zone 4A which as aforementioned is subdivided into two (2) sub-draw zones 4B and 4C.

Within draw unit 4 there is provided a set of feed rollers 5 at the yarn entrance side of the unit and a set of takeoff rollers 6 at the yarn exit side of the unit. Rollers 5 and 6 are rotatably mounted within draw unit 4 with parallel axes. Also seen in FIG. 1 are draw rollers 7 and a stretch form or pin 8. Each individual roller in the sets of rollers 5, 6 and 7 are tangent to a smaller clamp roller 9, 10 and 11, respectively, each movable by an individual piston and cylinder assembly. Basically, in the standard draw warping process, the threads are heated to at or above their glass transition temperature in draw zone 4A while being longitudinally stretched to draw the filaments to their final desired molecular orientation and finally warped onto a beam via a warping arrangement not shown in FIG. 1.

Planar heating panels 12 and 13 are provided. These arrangements may be moved from their active position as shown in FIG. 1 to an at rest position by means of control arrangements 14 and 15 respectively. Drive rollers 16, 17 and 18 are also shown between the intake rollers 5 and preheat plate 12, between the stretch form or pin 8 and the draw rollers 7 and between the heating plate 13 and the takeoff rollers 6, respectively. The drive rollers 16 and 18 form the beginning and end of draw zone 4A, with sub-draw zone 4B being defined between drive rollers 16 and 17 and sub-draw zone 4C being defined between drive rollers 17 and 18.

In the normal (i.e., no random variations) draw warping operation of the structure shown in FIG. 1, heating plate 13 is heated so that the filaments moving over the heating plate 13 are heated to a temperature above their glass transition temperature to allow for drawing and/or heat setting in zone 4C. In draw zone 4B preheating and primary drawing of the filaments takes place. The intake rolls 5 are heatable and are usually heated to a sufficient temperature, e.g., around 100° C., to serve as a preheating function. The intake rollers are assisted in their preheating function by preheating plate 12 which may typically be heated to about 90° C. The stretch form or pin 8 is non-rotating and heatable. In most instances, pin 8 is heated to a temperature which allows for the filaments to be heated (preferably to a temperature below their glass transition temperature) which provides for drawing in zone 4B. When pin 8 is used for a drawing function, a temperature in the range of approximately 105° C. is used to effect a uniform drawing.

In the preferred method of practicing the present invention, a plurality of partially oriented synthetic continuous filaments 1 traveling in parallel side-by-side relation on the draw warping unit 10 produce random denier variations along the length of each filament and randomly from filament to filament by causing the filaments to travel through intake rollers 5 and clamp roller 9 as shown in FIG. 1, around drive roller 16, over the preheating plate 12 and over pin 8, which is preferably allowed to rotate in an idling fashion. The threads 1 are then transported around drive roller 17 and through draw rollers 7 and clamp 10. Next, threads 1 are transported over heating plate 13 and around drive roller 10 through takeoff rollers 6 and clamp 11 to the draw warping arrangement (not shown) which receives the threads 1 in parallel and winds them about a warp beam.

Thus, the filaments are transported collectively through two draw zones 4B and 4C defined between first, second and third filament engaging members comprising the drive rollers 16, 17 and 18, respectively. While the threads are being transported through draw zone 4B, in previous draw warping systems the filaments are preheated and heated above their glass transition temperature, the filaments in the latter case also having a common lengthwise preliminary stretching force simultaneously imposed on the filaments within the draw zone. In previous draw warping assemblies, in operation of draw zone 4C, a further common lengthwise drawing force may be imposed collectively on the filaments while they are fully heated above their glass transition temperature to heat set the filaments in their desired final molecular orientation. However, in the preferred mode of practicing the instant invention, the operating parameters of the draw warp unit are altered to cause the filaments to slip sporadically on at least one of the filament engaging members intermittently preventing the filaments from fully stretching and causing the random yarn denier variations previously mentioned due to random drawing.

More particularly, under the present method, minimal heating is performed on the filaments in sub-draw zone 4B while a draw ratio is imposed in sub-draw zone 4B on the filaments which is less than a normal range of draw ratios utilized when draw warping the filaments to a uniform denier. For example, while normal draw ratios in the range of 1.65:1.0 to 2.0:1.0 are typically imposed in the draw zone 4B, the present invention contemplates a preferred draw ratio between drive roller 16 and drive roller 17 in sub-draw zone 4B of no more than about 1.55:1.0. This lower ratio places less tension on the yarn and, consequently, does not allow the yarn to be fully drawn or uniformly drawn because of the subsequent slipping of the yarn.

The present method may also significantly reduce the amount of heat to which the filaments 1 are exposed (i.e., temperature is below the glass transition temperature) in comparison to normal draw warping of the filaments to a uniform denier. First, the heated temperature of intake rolls may be lowered in comparison to normal draw warping operations, e.g., in the 50° C. to 60° C. range rather than the normal range of 60° to 100° C. Preheat plate 12 is not heated and may be moved to an out of contact position via control 14 if desired. In a typical draw warping operation, the preheat plate is set at 90° C. The pin or stretch form 8 also is not heated in the present invention and is allowed to rotate in an idling fashion, whereas in a normal draw warping operation the pin may be heated and may be fixed against rotation. The heating plate 13 in the present method may still be operated at a temperature above the glass transition temperature of the filaments to insure that they are capable of being heat set, but in at least some embodiments of the present method the temperature of the plate 13 may be reduced, e.g., to approximately 160° C. from a normal draw warping temperature of about 180° C. for higher denier polyesters. At the same time, the present method provides for the transporting of the filaments through the draw unit 4 at a traveling speed which is greater than a normal range of traveling speeds utilized when draw warping the filaments to a uniform denier. For example, in many embodiments of the present invention, the preferred traveling speed for the filaments is 625 yards per minute as opposed to the slower range of speeds in a conventional draw warping method of 600 yards per minute and less.

While the particular mechanisms by which these unusual operational parameters contemplated by the present invention accomplish random variations in the denier of the drawn yarns is not fully understood, it has been observed that the yarns 1 sporadically slip within the sub-draw zone 4B at least on the drive roller 16, which is believed to intermittently interrupt the otherwise normal process of drawing the filaments to a uniform denier. It is believed that the principal contributing factor producing this slippage is the lower than normal draw ratio utilized in the sub-draw zone 4B, but at the same time it has been observed that the imposition of lower levels of heating (i.e., below glass transition temperature) on the filaments contributes to the slippage of the yarn. Surprisingly, the denier variations occur randomly not only along the length of each yarn but also laterally across the warp sheet from yarn to yarn.

In summary, a method of producing random yarn denier variations randomly along the length of each yarn and randomly from yarn to yarn is disclosed which can be performed on existing draw warping units by altering normal operating parameters. The method provides for the transporting of the yarn filaments collectively through a draw zone defined between spaced filament engaging members and the imposing of a common lengthwise stretching force simultaneously to the filaments within the draw zone while preferably heating the filaments below their glass transition temperature and by causing the filaments to slip randomly on at least one of the filament engaging members.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of draw warping a plurality of partially oriented synthetic continuous filaments traveling in parallel side-by-side relation to produce denier variations randomly along the length of each filament and randomly from filament to filament, said method comprising the steps of:

(a) transporting the plurality of filaments collectively through a draw zone defined between first and second filament engaging members;

(b) simultaneously stretching the plurality of filaments within said draw zone while heating the plurality of filaments; and (c) effecting slippage of the plurality of filaments on at least of each filament and randomly from filament to filament to cause the plurality of filaments to draw non-uniformity and thereby to produce random denier variations both along each filament and from filament to filament.

2. The method of claim 1 wherein said imposing step comprises the step of: imposing a common lengthwise stretching force simultaneously to the filaments within said draw zone while heating the filaments below their glass transition temperature.

3. A method of draw warping according to claim 1 and further comprising the step of: imposing a draw ratio on the filaments which is less than a natural draw ratio for the filaments utilized when draw warping the filaments to a uniform denier.

4. A method of draw warping a plurality of partially oriented synthetic continuous filaments traveling in parallel side-by-side relation to produce denier variations randomly along the length of each filament and randomly from filament to filament comprising the steps of:

(a) providing a draw warping apparatus having means for lengthwise stretching of plural filaments in the form of a warp sheet in a draw zone defined between first and second filament engaging members and means for heating said filaments, said apparatus being normally operable when draw warping said filaments to a uniform denier to impose a predetermined ratio of drawing on said filaments at a natural draw ratio for the filaments and to apply a predetermined amount of heat to said filaments and to apply a predetermined amount of heat to said filaments at least at the glass transition temperature of the filaments;

(b) drawing said plurality of filaments at a sufficiently lower draw ratio than said natural draw ratio to effect slippage of said plurality of filaments on at least one of said filament engaging members randomly along the length of each filament and randomly from filament to filament to cause the plurality of filaments to draw non-uniformly and thereby to produce random denier variations both along each filament and from filament to filament; and (c) heating said plurality of filaments to a temperature which is less than said glass transition temperature.

5. A method of draw warping according to claim 4 wherein said draw warping apparatus has a pin which is disposed to extend laterally across the plurality of filaments in engagement therewith and means for selectively permitting or preventing rotation of said pin, said pin being normally and non-rotatable when draw warping the plurality of filaments to a uniform denier, said method further comprising permitting said pin to rotate freely under the traveling movement of the filaments.

6. A method of draw warping according to claim 4 wherein said draw warping apparatus further comprises means normally operable for preheating the plurality of filaments in advance of said draw zone when draw warping filaments to a uniform denier, said method further comprising deactivating said preheating means during said drawing and heating steps.

7. A method of draw warping according to claim 5 wherein said heating means includes means for normally heating said pin when draw warping filaments to a uniform denier, said method further comprising deactivating said pin heating means during said drawing and heating steps.

8. A method of draw warping a plurality of partially oriented synthetic continuous filaments traveling parallel side-by-side relation to produce yarn denier variations randomly along the length of each filament and randomly from filament to filament comprising the steps of:

(a) transporting said plurality of filaments in surface contact with draw warping feed rollers which are heated to approximately 60 percent of the glass transition temperature of the filaments;

(b) transporting said plurality of filaments over at least one deflecting means, said deflecting means providing essentially no heat to said plurality of filaments, said deflecting means being mounted to rotate;

(c) transporting said plurality of filaments over a heating plate;

(d) transporting said plurality of filaments through draw warping take off rollers; and (e) operating the draw warping machine at a draw ratio which is less than the natural draw ratio for the filaments, thereby causing said plurality of filaments to slip randomly and draw non-uniformly.

9. A method of draw warping according to claim 1 and further comprising the step of: heating the plurality of filaments at a temperature which is less than their glass transition temperature.

* * * * *

UNITED STATES PATENT AND TRADEMARK OFFICE

CERTIFICATE OF CORRECTION

PATENT NO. : 5,333,364

DATED : August 2, 1994

INVENTOR(S) : Jeffrey J. Enfield

It is certified that error appears in the above-identified patent and that said Letters Patent is hereby corrected as shown below:

Column 6, line 61, after "at least" insert — one of said filament engaging members randomly along the length —.

Column 6, line 63, delete "non-uniformity" and insert therefor — non-uniformly —.

Column 7, lines 24-25, delete "and to apply a predetermined amount of heat to said filaments".

Column 7, line 44, delete "and".

Column 8, line 17, after "traveling" insert — in —.

Signed and Sealed this

Twenty-fourth Day of January, 1995

*Attest:*

Bruce Lehman

BRUCE LEHMAN

*Attesting Officer*

*Commissioner of Patents and Trademarks*